US007045973B2

(12) United States Patent
Schallmoser

(10) Patent No.: US 7,045,973 B2
(45) Date of Patent: May 16, 2006

(54) OPERATING CIRCUIT FOR A DIELECTRICALLY IMPEDED DISCHARGE LAMP HAVING AN OVERVOLTAGE PROTECTION CIRCUIT

(75) Inventor: Oskar Schallmoser, Ottobrunn (DE)

(73) Assignee: Patent-Treuhand-Gesellschaft fur elektrisch Gluhlampen mbH, Munich (DE)

( * ) Notice: Subject to any disclaimer, the term of this patent is extended or adjusted under 35 U.S.C. 154(b) by 0 days.

(21) Appl. No.: 10/963,535

(22) Filed: Oct. 14, 2004

(65) Prior Publication Data

US 2005/0088116 A1 Apr. 28, 2005

(30) Foreign Application Priority Data

Oct. 22, 2003 (DE) ..... 103 49 548

(51) Int. Cl.
*H05B 37/02* (2006.01)

(52) U.S. Cl. ..... 315/291; 315/225; 315/276; 315/209 R

(58) Field of Classification Search ..... 315/291, 315/225
See application file for complete search history.

(56) References Cited

U.S. PATENT DOCUMENTS

| | | | | |
|---|---|---|---|---|
| 4,350,935 | A * | 9/1982 | Spira et al. | 315/291 |
| 5,982,106 | A * | 11/1999 | Bobel | 315/209 R |
| 6,011,358 | A * | 1/2000 | Knobloch et al. | 315/224 |
| 6,198,231 | B1 * | 3/2001 | Schemmel et al. | 315/225 |
| 6,274,987 | B1 * | 8/2001 | Burke | 315/307 |
| 6,781,326 | B1 * | 8/2004 | Stack | 315/291 |

* cited by examiner

*Primary Examiner*—Trinh V. Dinh
*Assistant Examiner*—Binh Van Ho
(74) *Attorney, Agent, or Firm*—Carlo S. Bessone

(57) ABSTRACT

The invention relates to a method and a circuit for starting or operating discharge lamps which are designed for dielectrically impeded discharges. In this case, it is established in advance, with the aid of an overvoltage protection circuit and test power pulses, whether the discharge lamp is connected.

14 Claims, 1 Drawing Sheet

OPERATING CIRCUIT FOR A DIELECTRICALLY IMPEDED DISCHARGE LAMP HAVING AN OVERVOLTAGE PROTECTION CIRCUIT

TECHNICAL FIELD

The present invention relates to a circuit and a method for operating a dielectrically impeded discharge lamp.

BACKGROUND ART

Dielectrically impeded discharge lamps are known per se and are largely distinguished by the fact that at least some of the electrodes used for igniting and maintaining the discharge are separated from the discharge medium by a dielectric layer. They are generally also known as "silent discharge lamps". Such discharge lamps are started and operated using electronic ballasts or, more generally, operating circuits. Higher voltages, and thus higher amplitudes when power is input, are generally required for ignition purposes than during continuous operation.

Operating circuits for such lamps generally contain a converter for inputting the power to the lamp. In principle, such discharge lamps having a very varied AC voltage rating are to be operated, in particular a pulsed mode of operation having power-input phases which are temporally separated by power-input-free times being of interest owing to the increases in efficiency achieved thereby. However, the invention relates in principle to operating circuits of any type for dielectrically impeded discharge lamps. It is known to connect a switching transistor, which is responsible, owing to its switching operation, for the ignition process and, in the event of a pulsed continuous power input, also for the actual lamp operation, in a line path supplying the converter with current. The converters used generally have an inductive characteristic; specifically they are generally transformers having a primary winding which has current applied to it by the abovementioned switching transistor.

It is likewise already known to protect this switching transistor for the event in which an attempt is made to start operation without a lamp having been correctly connected. In this case, energy is built up in the inductance of the converter, i.e. in the primary winding of a transformer, for example, and this energy, when it is not at least partially consumed by the lamp, is dissipated in the switching transistor. An overvoltage protection circuit may be used which measures the voltage across this transistor, for example the drain-source voltage in the case of a FET, and in the event of a threshold value being exceeded, ends the lamp operation.

DISCLOSURE OF THE INVENTION

The invention is based on the technical problem of improving an operating circuit for a dielectrically impeded discharge lamp having an inductive converter and an overvoltage protection circuit for a switching transistor and a method for starting such a dielectrically impeded discharge lamp such that they have improved properties when an attempt is made to start operation if a lamp is missing.

The invention relates to an operating circuit which is designed to apply, when restarting lamp operation, initially at least one test power pulse to the converter which is so small that destruction of the switching transistor as a result of this test power pulse is ruled out, and the overvoltage protection circuit responds to a voltage, produced by this test power pulse, across the switching transistor when no lamp is connected and does not respond when the lamp is connected.

It also relates to a corresponding method for starting the lamp.

The inventor has established that the described monitoring of the voltage across the switching transistor in cases which are relevant in practice is not always sufficient. For example, in particular in the event of higher lamp powers and/or when, depending on the circuitry, a dissipation of the energy stored in the converter inductance takes place in only one of possibly two or more switching transistors, destruction of the switching transistor may result so early that the overvoltage protection circuit mentioned does not respond quickly enough. The invention is therefore directed at preventing any energy which is critical for the switching transistor being built up in the converter inductance before it is established that a lamp has in fact been properly connected. Rather, in a phase which precedes the lamp starting, initially power pulses which are referred to here as test power pulses are applied to the converter. If there is no lamp, the inductance generates a higher induction voltage and thus produces a higher current or a higher power loss in the switching transistor or else a higher voltage drop across the switching transistor than when the lamp is connected, and thus a significant proportion of the energy from the inductance is consumed.

It should be noted here that, in the individual case, destruction of a switching transistor may result owing to currents, powers or else voltages which are too high. From the point of view of the inventor, it is destruction owing to currents which are too high which is primarily of importance. However, the invention is directed, independently of the precise destruction mechanism, at the protection of the switching transistor against instances of input power which is too "high". The test power pulses may therefore in the individual case be differentiated from the later starting power pulses or operating power pulses in terms of voltage, current and/or power, depending on the destruction mechanism to be expected.

The overvoltage protection circuit which is already known per se in principle may then be used, possibly also following matching to smaller threshold values, to differentiate between the two cases to be differentiated. In principle, a test power pulse is sufficient for this purpose; however, two or more such pulses are preferably emitted.

In one preferred embodiment, the converter is designed such that it operates using the flyback converter principle, i.e. in certain phases stores energy owing to the current flow through an inductance and emits this energy to the discharge lamp when the current flow is turned off. In this case, the switching transistor is therefore on in the energy store phases and off in the energy input phases. If energy is not input owing to the lack of a lamp being connected, the switching transistor is at risk, for example in the case of a MOSFET owing to an avalanche breakdown over the permissible operating range (i.e. operation, generally drain-source current outside the avalanche safe operating area (avalanche SOA)). Under consideration here are, in particular, so-called class E converters.

For the purpose of driving the control input of the switching transistor, for example the gate, a digital monoflop may advantageously be used, i.e. a monostable flipflop which, for a specific, predetermined time, assumes, in response to an input, an output state which drops back again to a stable basic state after this time. Reference is made to the exemplary embodiment.

The size of the test power pulses mentioned can be influenced, for example, by setting a reference value for a comparator which compares the current through the switching transistor with this reference value. In the case of the flyback converter, the comparator determines when the current flowing through the converter inductance and the switching transistor has reached a sufficiently high value to represent an amount of energy in the converter inductance which is suitable for a test power pulse. Here too, reference is made to the exemplary embodiment.

The reference value may advantageously be controlled via a microcontroller. The invention also preferably relates to such operating circuits in which the clocking of the converter is controlled by a (preferably the same) microcontroller. The converter clocking may in this case be controlled via the enable input of the monoflop mentioned, as is shown in the exemplary embodiment.

The overvoltage protection circuit mentioned which is known in principle is preferably provided with a peak-value rectifier, for example with a voltage divider circuit, a diode and a capacitor, and a low-pass characteristic, for example as a result of a resistive impedance interacting with the capacitance of the capacitor.

In addition, the invention is also based on a lighting system which is made up, as an assembly, of an operating circuit according to the above description and a dielectrically impeded discharge lamp which is suitable therefor and has preferably already been connected. This lighting system, however, is even the subject matter of the invention in the state in which it is not yet connected, i.e. for example when it is separate and packaged.

The invention also preferably relates to the case of a so-called flat radiator type of discharge lamp which comprises a planar, flat discharge vessel and is often used, but not exclusively, for back-lighting monitors. The invention also relates to this monitor, the term "monitor" in this case referring to both EDP monitors and television screens and display panels of other types. The invention is of interest in particular in the case of large-area flat radiators and monitors, for example having a format with a diagonal of over 20".

The invention is explained in more detail below with reference to an exemplary embodiment, in which the individual features disclosed below may also be essential to the invention in other combinations and all features both for the apparatus aspect and for the method aspect of the invention are of importance overall in the description above and below.

BEST MODE FOR CARRYING OUT THE INVENTION

Figure 1:
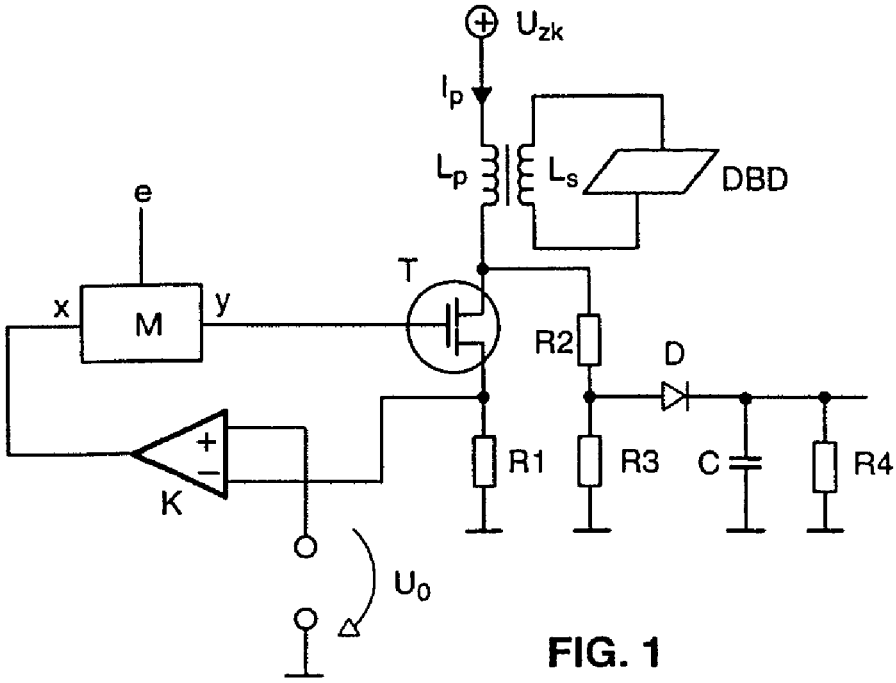
FIG. 1 shows a block circuit diagram of an operating circuit according to the invention.

In FIG. 1, a dielectrically impeded discharge lamp is given the reference DBD and is connected in a secondary circuit to a secondary winding $L_s$ of a transformer. The transformer has a primary winding $L_p$ which has power supplied to it from a voltage source $U_{zk}$, the intermediate circuit voltage of a generally known and conventional converter. This induces a flow of current, illustrated by the arrow and the symbol $I_p$, through the primary winding $L_p$ which then flows to ground via a MOSFET T, connected in series with the primary winding $L_p$, and a shunt resistor $R_1$. The gate input of the MOSFET switching transistor T which is shown on the left-hand side, is driven by a monoflop M having an input x and an output y and an enable input e. The input x of the monoflop M is in turn driven by a comparator K, at whose positive input a reference voltage $U_0$ is connected to ground, and at whose negative input the voltage between the source connection of the switching transistor T and the shunt resistor $R_1$ is connected to ground. The voltage to ground which is tapped off between the primary winding $L_p$ and the switching transistor T is split by means of a voltage divider circuit $R_2$, $R_3$, and is applied, via a diode D, to a capacitor C which is connected to ground on its other side. Connected in parallel with the capacitor C is a resistor $R_4$.

The mode of operation of the circuit is essentially as follows: When the switching transistor T is on, current flows through the primary winding $L_p$ and charges said winding inductively. If the switching transistor T is turned off, a sudden induction voltage, which means a power input pulse for the dielectrically impeded discharge lamp DBD, is produced at the primary winding $L_p$ and at the secondary winding $L_s$. In contrast, the induction voltages are applied to the secondary winding $L_s$ during the charge phase under the threshold required for discharge in the lamp DBD.

Figure 2:
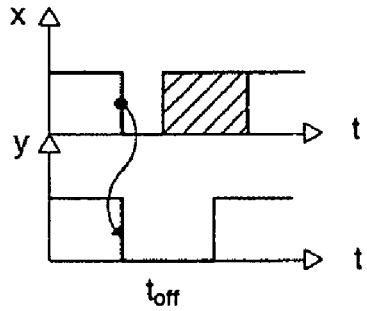
FIG. 2 shows schematically the mode of operation of a monoflop in FIG. 1.

The gate input of the switching transistor T is driven by the monoflop M which essentially operates as summarized in FIG. 2. In response to a falling edge of the input signal which is indicated at x at the top in FIG. 2, the output y of the monoflop M changes from the high level to the low level and remains at this low level for a specific, fixed time period $t_{off}$. Then, the monoflop drops back to the stable state at the high output level. This operation responds merely to the falling edge at the input x and is, as is indicated at the top in FIG. 2 by two different waveforms of the input signal x, completely independent of whether the input signal, again with a rising edge, returns to the high level before or after the end of the time period $t_{off}$.

The monoflop M thus defines the length of the power input phases of the transformer $L_p/L_s$. These power input phases are triggered via the input x. In addition, it is the case that the output of the monoflop M is always at the low level when the enable input e is at the low level. The enable input e enables the monoflop M at a high-level state, i.e. for the mode of operation described.

Accordingly, in the case of a fixed, predetermined reference value $U_0$, the intermediate circuit voltage $U_{zk}$ charges the primary winding $L_p$ of the transformer $L_p/L_s$ with the primary circuit current $I_p$ by means of the switching transistor T and the shunt resistor $R_1$ until the voltage to ground which is present across the shunt resistor $R_1$ reaches the value $U_0$ and thus brings about a change of mathematical sign of the output of the comparator K. This falling edge triggers the monoflop M, and turns the switching transistor T off for the time $t_{off}$, such that a power input phase begins. If now the discharge lamp DBD is not present or correct contact has not been made with it, the secondary winding $L_s$, which is now open, does not consume any power, which means that the induction voltage of the primary winding $L_p$ is relatively high. If the secondary winding $L_s$ were to consume power even when the lamp DBD has not been started but is only working capacitively, this induction voltage across $L_p$ would be significantly smaller. This can be found out via the voltage divider $R_2/R_3$ and the peak-value rectifier from the diode D and the capacitor C as well as the resistor $R_4$ (for the low-pass characteristic). However, in contrast to the prior art, this takes place in the case of relatively small test power pulses defined by the size of $U_0$ which are also not hazardous to the switching transistor T when no lamp DBD is connected. In any case, an avalanche breakdown of the switching transistor T in the permissible range (avalanche SOA) thus results.

If it is now established that no lamp is connected, the microcontroller which taps off the voltage across the resistor $R_4$ to ground can abandon continued operation and, if necessary, also emit a warning signal.

However, if it is established that a lamp DBD is connected, the microcontroller sets the reference value $U_0$ to be quite high. A very large number of larger power pulses are thus produced which result in a manner known per se in the lamp DBD being started by pulse bursts. Once the lamp has been started or a predetermined starting phase has elapsed, the reference value $U_0$ can be reduced again by the microcontroller in order to maintain the continuous operation of the lamp DBD at a reference value $U_0$ which is greater than the initial value used but is smaller than that used during the starting phase. The microcontroller may of course influence the length of the time $t_{off}$ of the monoflop by an internal voltage threshold value in the monoflop.

Figure 3:
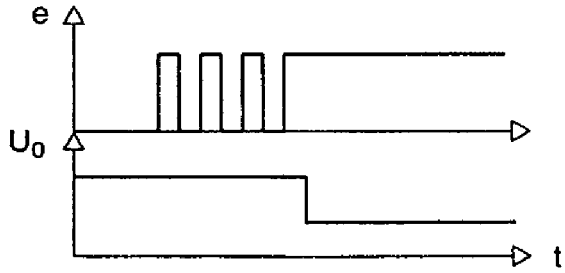
FIG. 3 shows a schematic time characteristic diagram in relation to FIG. 1 for the prior art.
Figure 4:
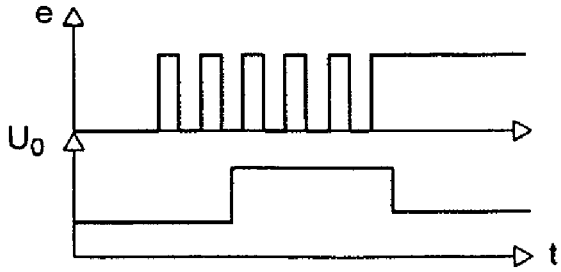
FIG. 4 shows a schematic time characteristic diagram in relation to FIG. 1 for the invention.

FIGS. 3 and 4 illustrate this in time characteristic diagrams, FIG. 3 showing the prior art. The time axis is given the reference t in both cases. In the upper region, the enable signal e is plotted vertically, and in the lower region, the reference value $U_0$ is plotted vertically. In FIG. 3, owing to repeated high-level phases of the enable signal, corresponding starting pulse bursts result which are essential for flat starting, in particular in the case of large-area flat radiator lamps. Thereafter, the reference value $U_0$ is reduced in favor of the continuous operation state which can be recognized by the continuously high-level enable signal.

FIG. 4 relates to FIG. 3 and shows, in contrast, the method according to the invention. Connected upstream of the starting phase in FIG. 3 is a phase having a very small reference value $U_0$ in which pulse bursts are likewise applied which contain test power pulses.

What is claimed is:

1. An operating circuit for a dielectrically impeded discharge lamp having an inductive converter for inputting power to the lamp, a switching transistor in a line supplying current to the converter, and an overvoltage protection circuit for detecting a voltage across the switching transistor and preventing lamp operation if a voltage which is above a predetermined threshold value is detected, in order to prevent the switching transistor being destroyed by energy input from the converter in the event of a lamp being absent, and the operating circuit being designed to apply, when restarting lamp operation, initially at least one test power pulse to the converter which is so small that destruction of the switching transistor as a result of this test power pulse is ruled out, and the overvoltage protection circuit responds to a voltage, produced by this test power pulse, across the switching transistor when no lamp is connected and does not respond when the lamp is connected.

2. The operating circuit as claimed in claim 1, in which the converter operates using the flyback converter principle.

3. The operating circuit as claimed in claim 1, having a monoflop for driving the control input of the switching transistor.

4. The operating circuit as claimed in claim 1, having a comparator for comparing the current through the switching transistor with a reference value, in which the size of the test power pulse is established by setting the reference value.

5. The operating circuit as claimed in claim 4 having a microcontroller which sets the reference value.

6. The operating circuit as claimed in claim 1 having a microcontroller which clocks the converter.

7. The operating circuit as claimed in claim 3, in which the microcontroller clocks the converter via an enable input of the monoflop.

8. The operating circuit as claimed in claim 1, in which the overvoltage protection circuit has a peak-value rectifier having a low-pass characteristic.

9. A lighting system comprising an operating circuit as claimed in claim 1 and a suitable dielectrically impeded discharge lamp.

10. The lighting system as claimed in claim 9, in which the lamp is a flat radiator.

11. The lighting system as claimed in claim 10, in which the flat radiator has a surface diagonal of at least 20".

12. A monitor having the lighting system as claimed in claim 1 for the purpose of back-lighting the monitor.

13. A method for starting a dielectrically impeded discharge lamp having the operating circuit as claimed in claim 1.

14. The operating circuit as claimed in claim 6, in which the microcontroller clocks the converter via an enable input of the monoflop.

* * * * *